US006745927B2

(12) United States Patent
Formon et al.

(10) Patent No.: US 6,745,927 B2
(45) Date of Patent: Jun. 8, 2004

(54) PAPER TOWEL DISPENSER

(75) Inventors: John S. Formon, Orange Park, FL (US); Andrew R. Morris, Green Cove Springs, FL (US); James H. Murphy, St. Augustine, FL (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 10/372,772

(22) Filed: Feb. 26, 2003

(65) Prior Publication Data

US 2003/0132261 A1 Jul. 17, 2003

Related U.S. Application Data

(62) Division of application No. 10/093,609, filed on Mar. 11, 2002, which is a continuation of application No. 09/081,637, filed on May 20, 1998, now Pat. No. 6,412,679.

(51) Int. Cl.[7] ..... B65H 35/10

(52) U.S. Cl. ..... 225/1; 83/371; 225/10; 225/14; 225/106; 242/564.4

(58) Field of Search ..... 225/14, 10, 106, 225/11, 15, 16, 1; 83/367, 370, 371, 649, 650, 358, 359; 226/43, 45, 48, 152, 134; 242/563, 563.2, 564.1, 564.4, 565

(56) References Cited

U.S. PATENT DOCUMENTS

| | | | | |
|---|---|---|---|---|
| 2,193,759 A | | 3/1940 | Birr | |
| 2,839,345 A | | 6/1958 | Engel et al. | |
| 2,859,814 A | | 11/1958 | Berney | |
| 3,384,280 A | | 5/1968 | Summersby | |
| 3,730,409 A | | 5/1973 | Ratti | |
| 4,099,118 A | | 7/1978 | Franklin et al. | |
| 4,267,752 A | | 5/1981 | Byrt et al. | |
| 4,464,622 A | | 8/1984 | Franklin | |
| 4,569,467 A | | 2/1986 | Kaminstein | |
| 4,666,099 A | | 5/1987 | Hoffman et al. | |
| 4,721,265 A | | 1/1988 | Hawkins | |
| 4,738,176 A | | 4/1988 | Cassia | |
| 4,786,005 A | | 11/1988 | Hoffman et al. | |
| 4,790,490 A | | 12/1988 | Chakravorty | |
| 4,796,825 A | | 1/1989 | Hawkins | |
| 4,823,663 A | | 4/1989 | Hamlin | |
| 4,826,262 A | | 5/1989 | Hartman et al. | |
| 4,960,248 A | * | 10/1990 | Bauer et al. | 242/564.4 |
| 5,031,258 A | | 7/1991 | Shaw | |
| 5,205,454 A | | 4/1993 | Schutz et al. | |
| 5,217,035 A | | 6/1993 | Van Marcke | |
| 5,235,882 A | | 8/1993 | Rabourn | |
| 5,257,711 A | | 11/1993 | Wirtz-Odenthal | |
| 5,335,811 A | | 8/1994 | Morand | |
| 5,452,832 A | | 9/1995 | Niada | |
| 5,505,129 A | | 4/1996 | Greb et al. | |
| 5,630,526 A | | 5/1997 | Moody | |
| 5,701,547 A | | 12/1997 | Yamada et al. | |
| 5,704,566 A | | 1/1998 | Schutz et al. | |
| 5,772,291 A | | 6/1998 | Byrd et al. | |
| 5,860,344 A | | 1/1999 | Yamamoto et al. | |
| 5,950,898 A | | 9/1999 | Menna | |
| 6,069,354 A | | 5/2000 | Alfano et al. | |
| 6,105,898 A | | 8/2000 | Byrd et al. | |
| 6,293,486 B1 | | 9/2001 | Byrd et al. | |

FOREIGN PATENT DOCUMENTS

| | | |
|---|---|---|
| DE | 334 29 21 | 6/1985 |

* cited by examiner

*Primary Examiner*—Allan N. Shoap
*Assistant Examiner*—Isaac Hamilton
(74) *Attorney, Agent, or Firm*—Banner & Witcoff, Ltd.

(57) ABSTRACT

A powered dispenser for dispensing individual paper towel segments from a continuous roll of paper provided with spaced lines of tearing comprises a housing, a support for the roll of paper, a feed mechanism, and a control device. The control device senses the presence of a user to activate the feed mechanism, controls the amount of material which is dispensed from the housing for any one cycle, and prevents further dispensing of the paper until the previous segment is separated from the roll. The control device detects the leading edge of the paper to initiate monitoring of the length of paper to be dispensed to prevent any cumulative error in dispensing the segments.

4 Claims, 6 Drawing Sheets

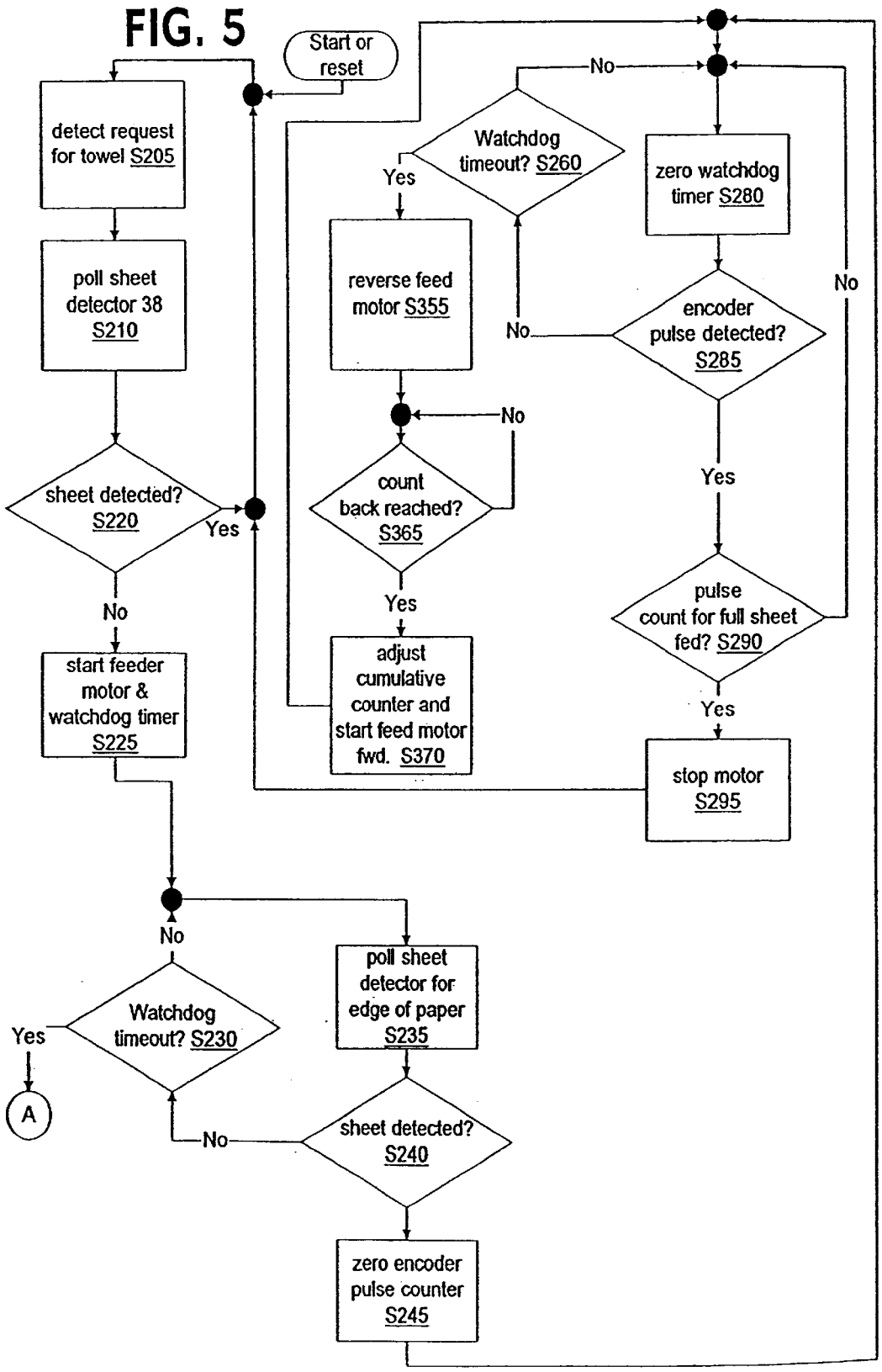
FIG. 5
Start or reset
detect request for towel S205
poll sheet detector 38 S210
sheet detected? S220
Yes
No
start feeder motor & watchdog timer S225
Watchdog timeout? S230
Yes
A
No
poll sheet detector for edge of paper S235
sheet detected? S240
No
zero encoder pulse counter S245
Watchdog timeout? S260
Yes
No
reverse feed motor S355
count back reached? S365
No
Yes
adjust cumulative counter and start feed motor fwd. S370
zero watchdog timer S280
encoder pulse detected? S285
No
Yes
pulse count for full sheet fed? S290
No
Yes
stop motor S295

PAPER TOWEL DISPENSER

This application is a divisional application of pending U.S. application Ser. No. 10/093,609, filed Mar. 11, 2002, which is a continuation application of U.S. application Ser. No. 09/081,637, filed May 20, 1998 (CPA filed Jan. 12, 2001), now U.S. Pat. No. 6,412,679.

TECHNICAL FIELD

The present invention generally relates to paper towel dispensers and, more particularly, to a non-touch paper towel dispenser for dispensing a web of material from a roll.

BACKGROUND OF THE INVENTION

Dispensers for toweling have primarily been designed to dispense a continuous length of web material, folded paper towels, or rolls of paper towels. Continuous towels are generally made of a reusable material and form a towel loop outside of the dispenser cabinet for the consumer to use. Folded towels are paper towels which are pre-cut and folded into various configurations to be individually dispensed for use. Roll towels are continuous rolls of paper toweling which are wound around a central core and which are, upon dispensing, separated into and delivered as individual lengths of material.

Continuous web dispensers, such as those disclosed in U.S. Pat. No. 2,930,663 to Weiss and U.S. Pat. No. 3,858,951 to Rasmussen, require the user to pull on the loop of exposed toweling in order to cause a length of clean toweling to be dispensed and the exposed soiled toweling to be correspondingly taken up within the dispenser. Although economical, the continuous exposure of the soiled toweling is deemed unsightly and, therefore, unacceptable to many consumers when compared to the many available alternatives. Further, the exposure and possible reuse of soiled toweling may present additional health hazards and sanitation concerns which should be avoided.

The use of interfolded paper towels or C-fold paper towels eliminates the potential health risks associated with continuous web toweling. For instance, dispensers for folded paper towels, such as disclosed in U.S. Pat. No. 3,269,592 to Slye et al., allow a user to dispense the towels by pulling on the exposed end of each new individual towel. These dispensers are also easy to refill with folded towels. However, a number of the folded towels will sometimes drop out of the lower opening of the dispenser when only the exposed towel is pulled, especially when the stack of towels in the dispenser is small. This can result in a significant waste of paper towels. Accordingly, folded towels are not as economical as other kinds of alternative dispensers.

Roll towels are cheaper to manufacture and produce less waste than folded towels. Roll towels also eliminate the potential health and sanitation problems associated with continuous web toweling systems. Dispensers for roll towels may include a lever, crank, or other user-activated mechanism for dispensing a length of towel, and a blade for severing the length of towel from the remaining roll. However, as can be appreciated, manual contact with a dispensing lever or the like raises health concerns for the user. To alleviate these health concerns, dispensers, such as U.S. Pat. No. 4,712,461 to Rasmussen, eliminate contact with any part of the dispenser, and instead rely upon the user directly pulling the paper towel out of the dispenser. As a result, the paper towel must be provided with sufficient strength to effect rotation of the feed roller and actuation of the blade without premature tearing. Paper possessing the requisite strength to operate the dispenser is limited in the amount of softness and absorbency which can be provided to the paper towels.

Dispensers for roll towels have also been electrically powered. As shown in U.S. Pat. No. 5,452,832 to Niada, a light sensitive device is used to detect the presence of a user's hand in front of the dispenser and advance the toweling for a predetermined length of time. The dispensed length of paper towel is then separated from the continuous web by pulling the paper against a serrated cutting member. While the feed roller is powered, the cutting action still requires the paper to possess a certain minimum strength and generally produces a rough, unsightly cut.

U.S. Pat. No. 4,738,176 to Cassia discloses an electrically powered dispenser which also includes a reciprocating cutter to produce an individual towel from the continuous web of paper. While this arrangement enables the use of softer and more absorbent paper, the dispenser requires a substantial amount of energy to drive the feed mechanism and the reciprocating cutter. Accordingly, the batteries must be replaced much more frequently. Moreover, the system is more complex and costly with its use of one-way clutches.

Also, in some electrically powered dispensers, such as U.S. Pat. No. 4,796,825 to Hawkins, the paper will continually dispense while a hand or other object is placed in front of the sensor. Hence, the dispenser is subject to easy abuse and waste of paper. Moreover, some dispensers are subject to dispensing paper by the general proximity of a person irrespective of whether a paper towel is needed. In an effort to avoid abuses, some dispensers, such as U.S. Pat. No. 4,666,099 to Hoffman, have incorporated a waiting period where the dispenser will not operate for a brief time after each use. However, the need to wait can be frustrating to users under some circumstances.

SUMMARY OF THE INVENTION

The present invention is directed to an electrically powered dispenser which overcomes the disadvantages of the prior art.

In one aspect of the present invention, the dispenser facilitates the dispensing of a roll of paper with spaced apart transverse lines of tearing (e.g. perforation lines) for easily separating individual sheets from the continuous roll without cutting. As a result, paper with a high degree of softness and absorbency can be used without the high energy demands required by a reciprocating cutter.

In another aspect of the invention, the dispenser senses the leading edge of the continuous web of paper material to initiate a control device which controls the length of each segment of paper. In this way, the dispenser can always place the transverse tearing line at the proper position in relation to the discharge opening for each dispensed sheet, irrespective of variations of the spacing for the tearing lines within a tolerance range.

In another aspect of the invention, the dispenser includes a sensor for sensing the presence of a sheet which has been dispensed, but not removed, in order to prevent the dispenser from dispensing any more sheets until the previous sheet has been tom off. In this way, abuse of the dispenser and waste of the paper material can be minimized without requiring the use of a waiting period wherein the dispenser will not operate. Accordingly, the dispenser is always ready for use.

BRIEF DESCRIPTION OF THE DRAWINGS

FIGS. 5 and 6 are flow diagrams showing alternative jam clearing methods consistent otherwise with the control flow of FIGS. 3 and 3*a*.

DETAILED DESCRIPTION OF PREFERRED EMBODIMENTS

Figure 1:
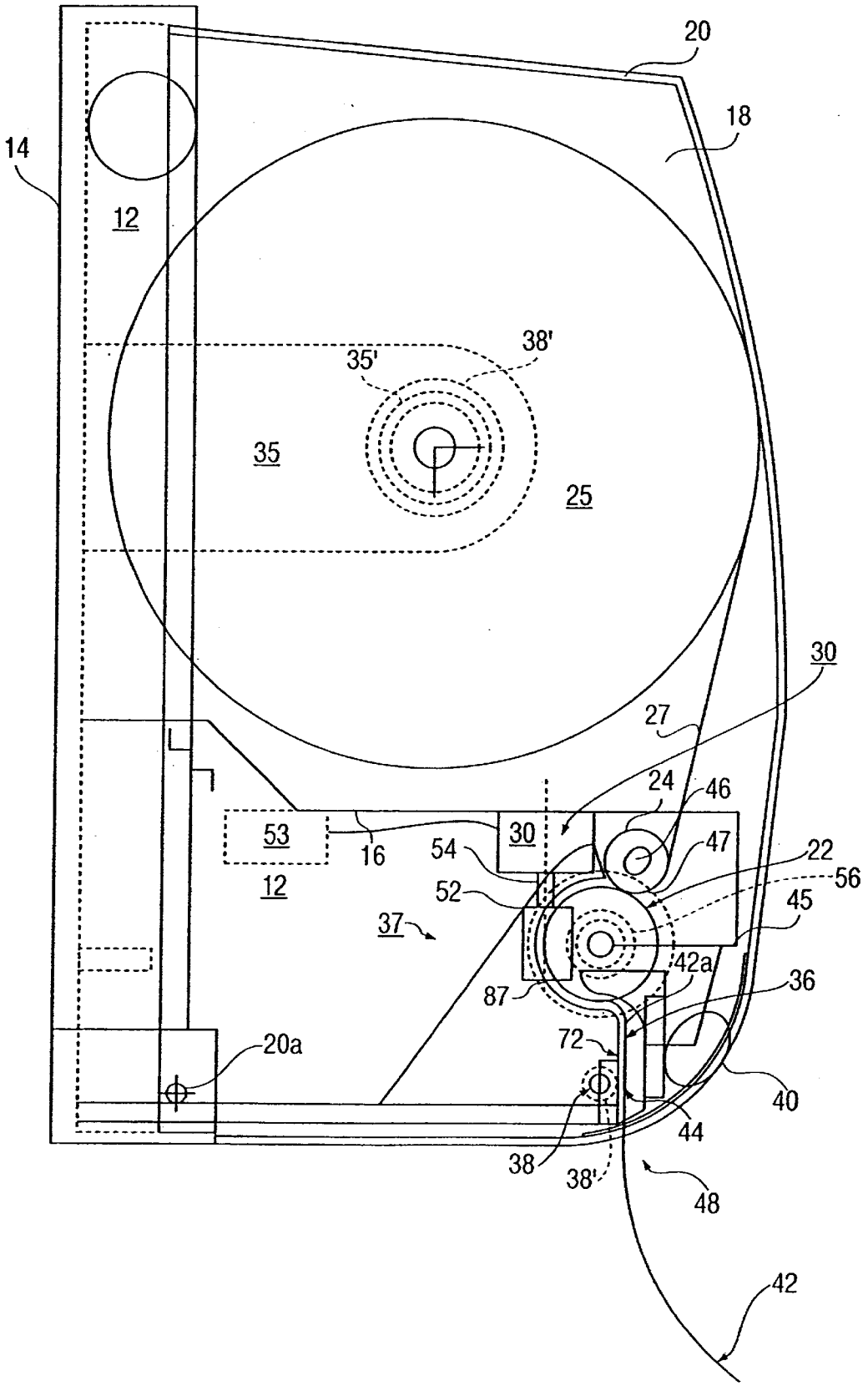
FIG. 1 is a side diagrammatic view of the dispenser of the present invention with the cover in a closed position and showing a sheet segment of a web being dispensed.
Figure 4:
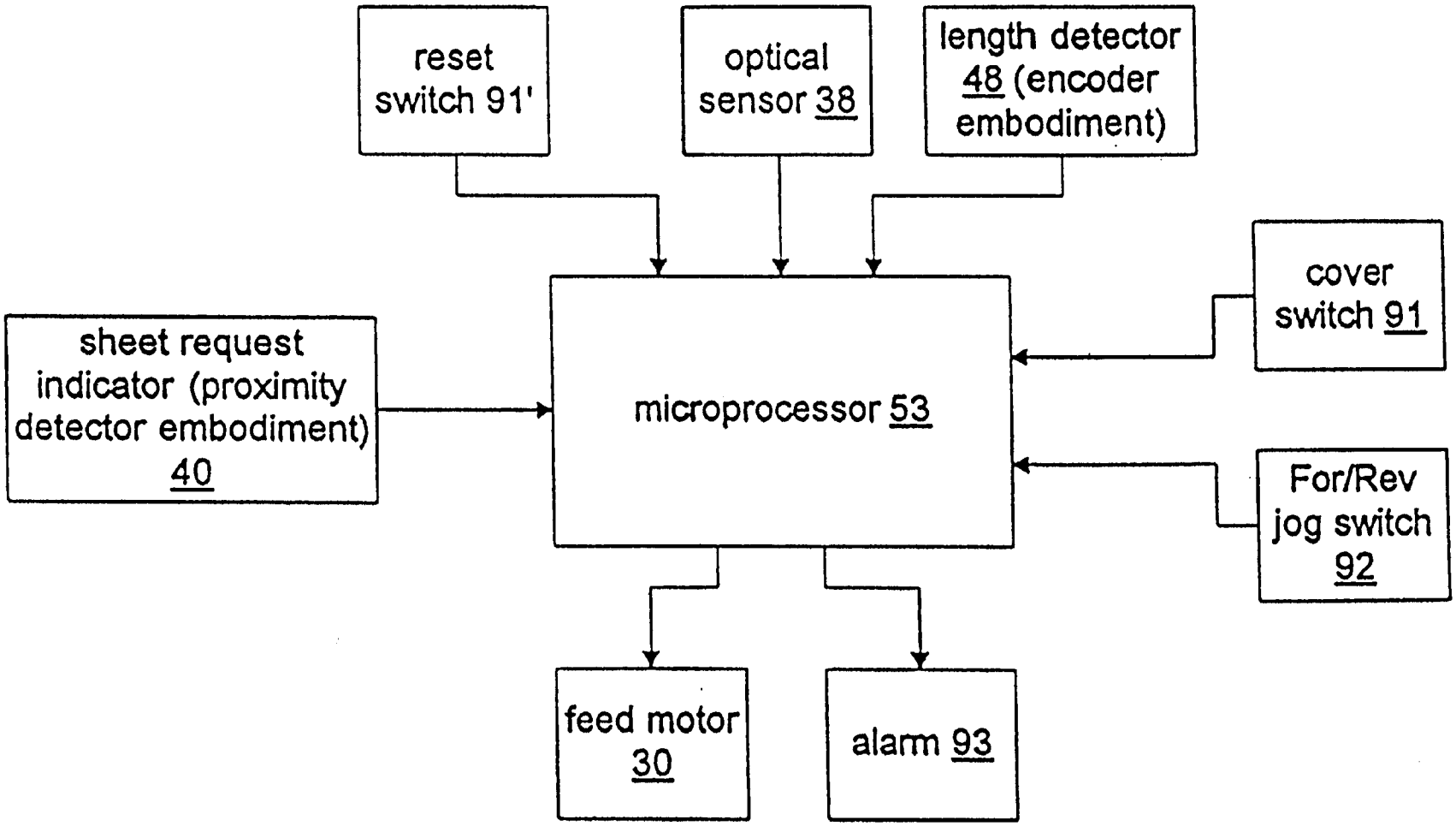
FIG. 4 is a block diagram showing control elements for controlling a towel feeder according to embodiments of the invention.

Referring to FIGS. 1 and 4, a non-touch paper towel dispenser 10 according to the present invention comprises a chassis 12 which includes a back panel 14, side panels 16, and a pivotal front cover 20 attached by a pin, hinge, or other conventional attachment mechanism 20*a* (FIG. 1). Front cover 20 is opened to permit loading of a roll of paper material 25 into dispenser 10. The roll 25 consists of a continuous web of paper 27 wound upon a hollow, cylindrical core (not shown). In the preferred embodiment, the web 27 includes a series of spaced apart, transverse tear lines to subdivide the web into sheet segments 42 of a predetermined length. Roll 25 is rotatably supported a pair of arms 35 extending forwardly from back panel 14. Each of the arms includes inwardly directed hub 35' loosely received within the core 38' of the roll 25 to permit free rotation of the roll 25. Nevertheless, other mounting arrangements could be used.

A feed mechanism 37 is mounted within the housing defined by chassis 12 to dispense the web 27 in incremental sheet segments 42. In the preferred construction, feed mechanism 37 includes a feed roller 22 and a pressure roller 24. Feed roller 22 and pressure roller 24 are mounted upon axles 45, 46, respectively, rotatably supported by side panels 16, 18. The pressure roller 24 is preferably biased against the feed roller by a spring (not shown) to define a feed nip 47 for dispensing the web 27 through a discharge opening 48. The discharge opening includes a towel sensor 38 as described below.

In use, feed roller 22 is driven by an electric motor 30 mounted within the dispenser. Specifically, a worm gear 52 is secured to drive shaft 54 of motor 30 to engage a drive gear 56 secured to axle 45 and rotate feed roller 22. When the paper web 27 is fed into nip 47, rotation of the feed roller (counter clockwise as viewed in FIG. 1) causes the web to be advanced around feed roller 22, through discharge opening 48. A guide plate 87 is provided to direct the web along the desired path. Low power requirements insure that the batteries 58 need only infrequent replacement. Other feed mechanisms having other roller and gear arrangements, or other power supplies, such as a step down AC to D.C. power supply, could be used.

When a roll 25 is loaded into dispenser 10, the leading edge 36 of web 27 is manually fed rearward between feed roller 22 and pressure roller 24. When front cover 20 is closed, a loading switch (not shown) may be engaged to activate motor 30 and automatically drive feed roller 22 in a direction (i.e. counterclockwise as viewed in FIG. 1) to advance web 27 around feed roller 22 and to discharge opening 48. Alternatively, as described in the control embodiment of FIG. 2, a custodian can set up the roll 25 and web 27 such that the leading edge 36 is downstream of the sheet sensor 38. When cover closure is detected, the motor 30 will run in reverse to bring the leading edge 36 upstream of the sheet sensor 38 and then stopped (See discussion of FIG. 2, below, for further explanation). The custodian can use a forward and reverse jog switch 92 to position the leading edge where desired. While the loading switch is preferably actuated automatically upon closing of the cover, it could be manually actuated if desired. The leading edge 36 of the web material is advanced until detected by towel sensor 38 positioned in discharge opening 48. The towel sensor 38 is coupled with a microprocessor 53 or the like so that once the leading edge has been detected by sensor 38, motor 30 is reversed until the leading edge 36 of web 27 is clear of the range of sensor 38. This position places the leading edge 36 between the feed roller 22 and sensor 38. The towel sensor 38 may be any suitable mechanism, for example, a limit switch (not shown), an acoustical sensor (not shown), or an optical sensor 38 that includes an emitter and a photo diode that is occulted by the leading edge 36 of the web. In the latter example, the emitter may be pulsed and the output of the photodiode high-pass filtered. In this way the effect of ambient light on the photodiode is compensated. This may be implemented directly through microprocessor 53.

The present invention is preferably used for dispensing web material with spaced apart tearing lines, such as prescored lines of perforation, resulting in sheet segments 42 of, for example, nine inches in length. Of course other lengths could be used depending on designer preference. By using a preperforated web material, the sheet segments can be easily separated from the web without requiring cutting of the web. The perforation tensile strength is light enough such that the web material can be easily separated in a smooth edge or some other desired or appealing edge. By avoiding the need for a cutter, energy may be conserved because the motor needs only to rotate the feed roller. Because the web 27 is power fed, minimum strength is required of the web. The web does not need to have sufficient strength to draw out additional portions as a leading portion is removed as in dispensers that require the web to be pulled out manually. Thus, the paper material of which the web is made can be soft and highly absorbent.

Dispenser 10 further includes a proximity sensor 40 that detects the presence of a user's hands or the like as the hand or hands approach the front of the dispenser 10. Sensor 40 may be any kind of suitable proximity sensor or switch. For hands free operation, sensor 40 may be a proximity sensor. A proximity sensor 40 is coupled with microprocessor 53 to activate motor 30 when a hand is detected so as to drive feed roller 22 and thereby dispense a predetermined length of the web material. The dispensed web exits through discharge opening 48, in order to be easily accessible to the user. The user then grasps the dispensed sheet segment 42 of web material and tears off the desired length of material along a prescored perforation line 72 (see FIG. 1). The leading edge 36 of the next sheet segment 42*a* is positioned between towel sensor 38 and feed roller 22. If the user dispenses, but does not separate it from the web, the towel sensor 38 detects the presence of the segment 42*a*. As long as sheet segment 42*a* is detected by sensor 38, the microprocessor will prevent further activation of motor 30. This discourages abuse of the dispenser and waste of the paper. Also, while the towel sensor 38 is described as a single, centrally positioned sensor in discharge opening 48, a pair of spaced towel sensors 38, 38' could also be provided. In this case, even if the leading towel segment is irregularly torn, apart from the tearing line, only one towel sensor need be uncovered to enable activation of the motor.

As explained further below, dispenser 10 feeds a single sheet segment 42 of web 27 after detecting that a previously fed sheet segment has been separated from the web 27. To control the amount of web 27 fed so that one sheet segment only is fed, dispenser 10 employs a length detector 48 which establishes the amount of web fed during each dispensing cycle each time the motor is activated. The length detector 48 may be, for example, an encoder, either electromechanical or optical, that outputs a pulse for each increment of web dispensed. The length detector 48 may be coupled to microprocessor 53 and employed in controlling the dispenser 10 as discussed below. Another alternative to encoding successive incremental displacements of the web 27 is to detect the difference in transmissivity of the web when a perforation line crosses an optical interrupter. That is, an emitter-photodiode combination may be used to provide a signal that indicates a first level of light reception as web is fed and when the perforation crosses the light path. A pulse may be generated by the presence of the perforations through the web. The microprocessor 53 may count the pulses generated by the length detector 48 where an encoder embodiment is employed to dispense the proper amount of web material. For instance, when the tearing lines are nine inches apart, the microprocessor counts the corresponding number of pulses to dispense nine inches of the web 27. While a dispenser is preferably set to dispense a roll with sheet segments (or a multiple of sheet segments) of a predetermined length, a switch, dial, button or other means could be used to adjust the length of the dispensing cycle to meet different kinds of rolls. Also, other control devices could be used, including other counting arrangements or a timer device. Note that in the encoder embodiments of length detector 48, as discussed below, cumulative error does not occur because cumulation of incremental lengths does not begin until the leading edge 36 is detected. Thus error can only accumulate over the span of a single sheet segment 42.

If a user pulls on the leading edge of the sheet segment being dispensed before the cycle has been completed, the motor 30 may stall due to the increased load placed on the worm gear 52. The web 27 may be prevented from slipping about feed roller 22 when pulled because of the braking characteristic of the worm gear and the pinching engagement of the feed nip 47. When the motor stalls, the microprocessor 53 may store the cumulative displacement and reactivate the motor to dispense the remaining portion of the sheet segment after a short pause (See FIG. 6 and attending discussion, below). Alternatively, the motor may be reversed so that the sheet segment is pulled upstream of the towel sensor 38 and fed forward again to register the portion of the leading edge again in preparation for a new dispensing cycle.

Figure 2:
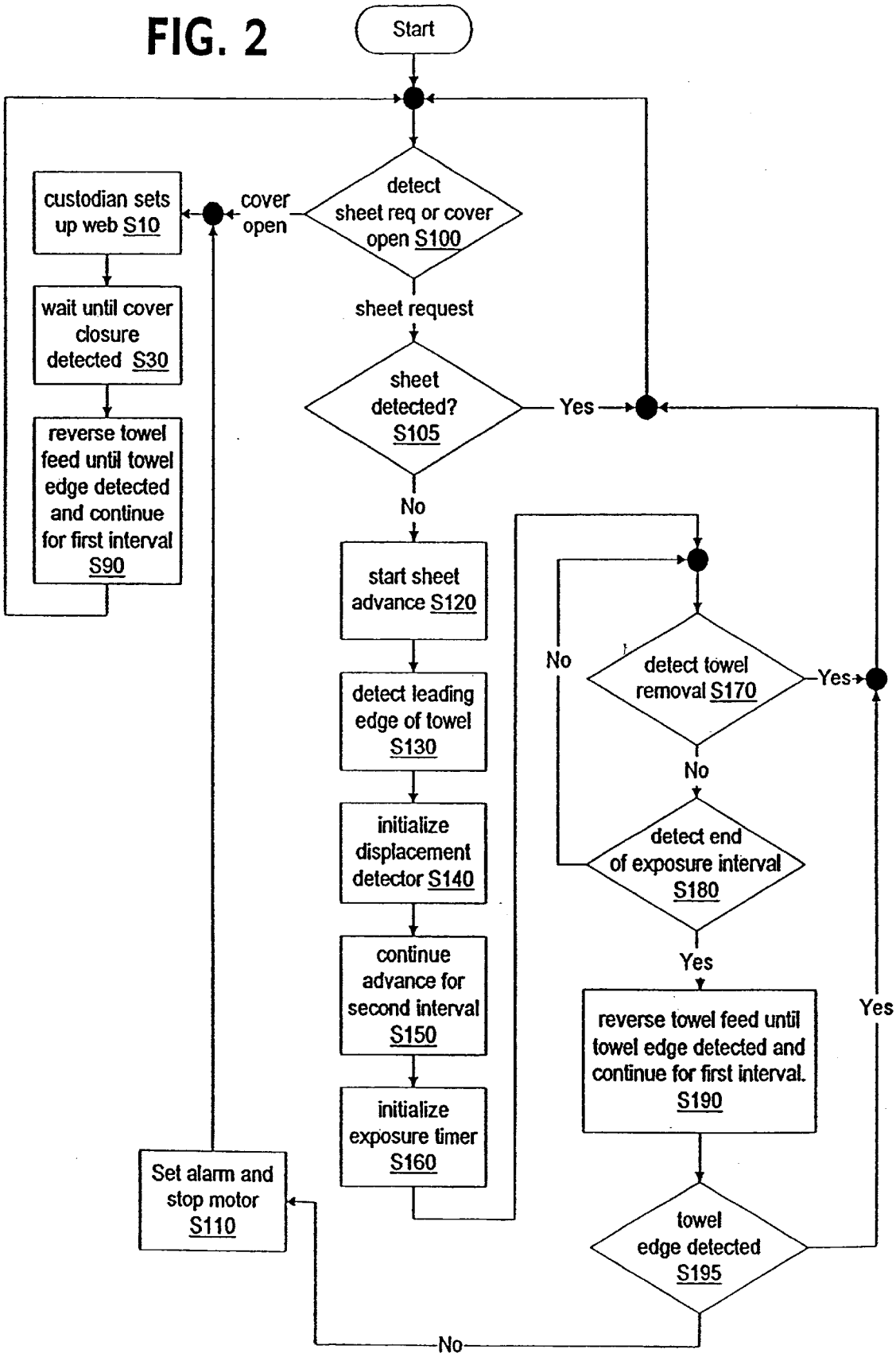
FIGS. 2 and 3 are flow diagrams showing flow control for operating a dispenser according to embodiments of the invention.

Referring to FIG. 2, control flow for embodiments of towel dispenser 10 may begin with the detection of an open cover or towel request at step S100. If a sheet request is made, control proceeds to step S105 where it is determined if a towel is present, that is, if a previously fed towel has not been torn off. If a towel is present, control returns to step S100 otherwise it proceeds to step S120 where the feed motor 30 is started in the forward feed direction. The feed motor 30 continues until in step S130, the leading edge of the towel is detected at which point, the length (displacement) detector 48 is initialized in step S140 so that the total displacement of the web 27 can be detected. The web 27 is advanced for the predefined displacement to expose one full towel sheet segment 42 in step S150 as indicated by the length detector 48. Next, in step S160, an exposure timer is initialized. Next, at step S170 optical sensor 38 is polled to determine if a towel has been removed within the duration of the exposure timer. If not, control loops until the exposure timer times out at step S180. If the towel is removed before the exposure timer times out, control returns to step S100. If the exposure timer times out in step S180, control proceeds to step S190 where the feed motor 30 is reversed to draw the towel back inside the dispenser 10. In step S190, the reverse feed continues for a short first interval to draw the leading edge back past the towel sensor 38. If the towel edge was not detected due to some error in step S195, an alarm is set at step S110 and control proceeds to step S10. If the towel edge 36 is successfully detected (Step S190 may include a timer operation so that the program may wait for a predetermined period of time before proceeding to step S195), control returns to step S100. If a cover-open condition is detected in step S100, control also proceeds to step S10. The program pauses at step S30 until a cover closure is detected at step S30, whereupon control proceeds to step S90. In step S90, the feed motor 30 is reversed in an operation as in step S190. Then control returns to step S100 where the dispenser 10 waits for another sheet request.

Figures 3, 3A:
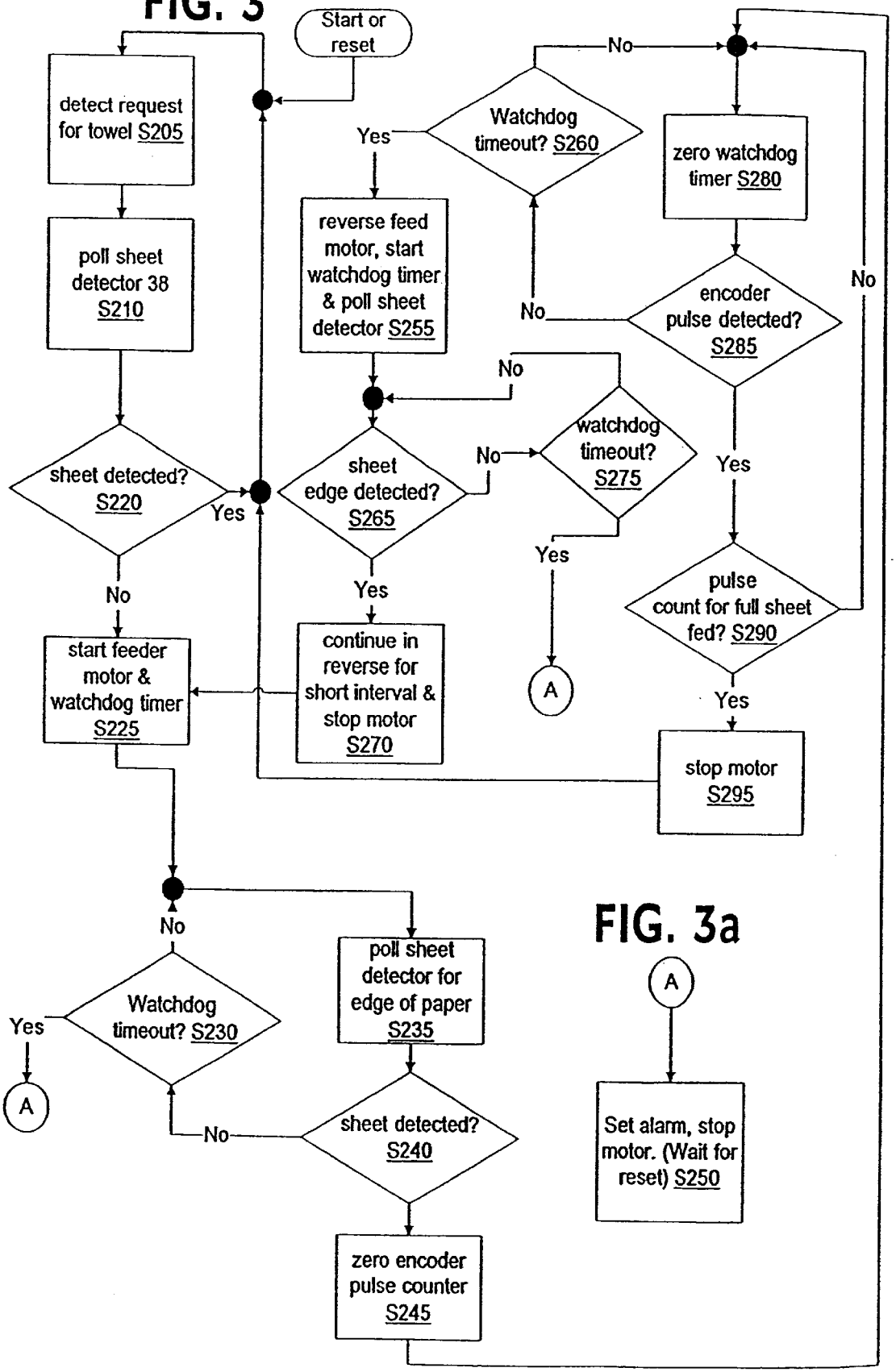
FIG. 3*a* is a portion of a routine for dealing with alarm conditions in the control flow shown in FIG. 3.

Referring to FIG. 3, an alternative control flow begins when the dispenser is reset (either power on or pressing a reset button 91') whereupon control begins at step S205. In step S205, the processor 53 waits for a sheet request. As discussed above, this request may be made by a proximity sensor in one embodiment, or by some other type of switch or indicator. When a sheet request is made, control passes to step S210 where the sheet detector 38 is polled to determine if a sheet segment is still present having been ejected previously and not torn off. At step S220, if a sheet is detected, control returns to step S205. If the sheet is not detected, the feeder motor is started in step S225 and a watchdog timer initiated. Then in step S235, the sheet detector is polled and at step S240 if the sheet is detected, control proceeds to step S245. If the sheet is not detected, control loops back through steps S230 to S235 until the watchdog timer times out in step S230 whereupon control branches to step S250 in which an alarm is set and the motor stopped to wait for reset.

Note that in step S235, the presence of the sheet is an indication of the leading edge of the web. Therefore, in step S245, the encoder pulse detector of the encoder embodiment (length detector 48) is zeroed and control flows to step S280. In step S280, another watchdog timer is started and the processor waits for each encoder pulses by looping through steps S285 and S260. If the watchdog timer times out between pulses, control branches out of this loop to step S255. Each time a pulse is detected, control flows to step S290 where the pulse counter is checked against the cumulative count of pulses thus far. If the cumulative count is short of the number corresponding to a full sheet, control returns to step S280. If all the pulses are cumulated through the S280, S285, S290 loop, control proceeds to step S295 where the motor is stopped. Control then returns to step S205.

If the watchdog timer in step S260 times out, control proceeds to step S255 where the feed motor 30 is reversed and another watchdog timer is initiated. The sheet detector is polled and control loops through steps S265 and S275 until either the watchdog timer times out or the edge is detected. If the edge is detected the feed motor continues in reverse for a short interval to bring the sheet edge upstream of the optical sensor (sheet detector) in step S270. Then control proceeds to step S225. If the watchdog timer times out in step S275, control proceeds to step S250.

Note that in either of the above control embodiments or any others (FIG. 2 or 3), a routine may be included to insure prevention of more than a predefined number of sheets from being dispensed within a specified time interval. If more than this predefined number of requests is made, the controller may be programmed to ignore the request until the lapse of a timer. So, for example, if more than three requests are made in a 10 second period, the processor can wait until the expiration of the ten second interval or for the expiration of a new 10 second interval after the third request. This is an abuse deterrent.

Note that discharge opening 48 defines an access that is narrow enough to prevent a user's fingers from reaching the leading edge 36 of the web 27 when the dispenser 10 is waiting for a request for a new paper sheet segment. The towel sensor 38 is located between the access defined by the discharge opening 48 and the blind end defined by a feedthrough between feed roller 22 and an arcuate guide plate 87. With this arrangement, the towel sensor is hidden from interference by ambient light. Also, the perforation line 72 is located downstream of the blind end so that a sheet segment 42 can be tom away from the web 27. The perforation line 72 is above the towel sensor 38 when the dispenser 10 is waiting for a request. In this way the towel sensor 38 registers the position of the leading edge 36 shortly after the motor 30 starts feeding forward.

The control flow starting with step S255 is for the purpose clearing a jam. Referring to FIG. 5, an alternative way of dealing with the timeout in step S260 of the watchdog timer begins at step S355 where the feed motor 30 is reversed. Control loops through step S365, until the encoder pulses are cumulated for a short number of counts, perhaps only one or two. Thus, the feed motor is reversed for only a short interval of reverse displacement. The count of the forward feed operation is then adjusted in step S370 and the feed-forward operation resumed at step S280. Thus, if two backward pulses are used for this correction, the cumulative count employed in step S290 would be decremented by two to make up the difference.

Figure 6:
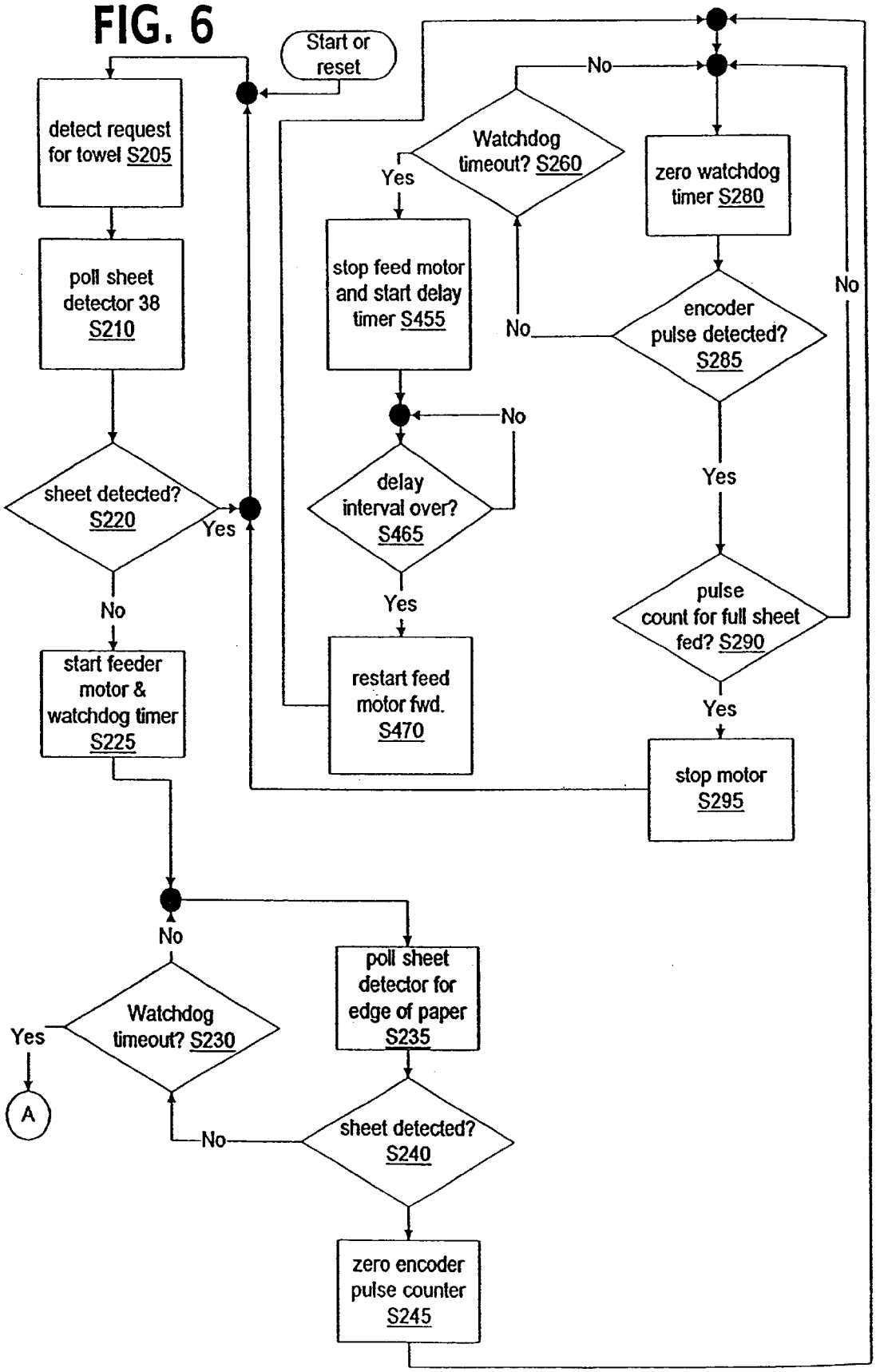

Another alternative way to deal with a jam is to simply pause the forward feed operation. Referring to FIG. 6, in step S455, the feed motor 30 is stopped and a delay timer initiated. Control loops through step S465 until the delay timer times out and the feed motor is restarted in step S470. After that control returns to step S280.

Referring to FIG. 4, a block diagram showing the various sensors and controls that may be connected to microprocessor 53, according to the various embodiments discussed above, is shown.

It will be obvious to one of ordinary skill in the art that numerous modifications may be made without departing from the true spirit and scope of the present invention, which is to be limited only by the appended claims.

What is claimed is:

1. A method of dispensing individual segments from a continuous strip of sheet material having a plurality of spaced tear lines therealong defining leading and trailing edges of individual removable segments, with an outer segment having a free leading edge and inner segments which in turn become outer segments as adjoining outer segments are removed, the method comprising:

repeatedly moving the sheet material so as to advance successive outer ones of said segments out of a housing, said moving comprising moving, in a first interval of movement, a said free leading edge of the sheet material to a first position defining the beginning of an interval of advancement following said first interval of movement;

terminating the advance of the sheet material when said free leading edge of the sheet material has advanced from said first position a predetermined amount, to repeatedly place said spaced tear lines at a second position spaced from said first position an amount that is variable in relation to variation in the length of said segments, said second position defining the beginning of a said first interval of movement for a next adjacent segment, when it is in turn dispensed; and permitting removal of a said outer segment from the strip of sheet material along a said tear line thereof, such that a new free leading edge is placed in said second position.

2. The method of claim 1, wherein said first interval of movement advances said sheet material.

3. A method of dispensing individual segments from a continuous strip of sheet material having a plurality of spaced tear lines therealong defining leading and trailing edges of individual removable segments, with an outer segment having a free leading edge and inner segments which in turn become outer segments as adjoining outer segments are removed, the method comprising:

repeatedly advancing the sheet material to advance, in first and second intervals, successive outer ones of said segments out of a housing;

detecting arrival of a said leading edge of the advancing sheet material at a first position within said housing defining the end of said first interval and the beginning of said second interval, as the sheet material is repeatedly advanced out of the housing;

terminating the advance of the sheet material when a said leading edge of the sheet material has further advanced from said first position a predetermined amount, to repeatedly place said spaced tear lines at a second position that is variable within a space defined between a feed mechanism and said first position in relation to variation in the length of said segments, said second position defining the beginning of a said first interval of advancement for a next adjacent segment, when it is in turn dispensed; and permitting removal of a said outer segment from the strip of sheet material along a said tear line thereof, such that a new free leading edge is placed in said second position.

4. The method according to claim 3, wherein said leading edge of the advancing sheet material is a said free leading edge.

* * * * *